US005977918A

United States Patent [19]

Sirmalis

[11] Patent Number: 5,977,918

[45] Date of Patent: Nov. 2, 1999

[54] EXTENDIBLE PLANAR PHASED ARRAY MAST

[75] Inventor: John E. Sirmalis, Barrington, R.I.

[73] Assignee: The United States of America as represented by the Secretary of the Navy, Washington, D.C.

[21] Appl. No.: 08/936,787

[22] Filed: Sep. 25, 1997

[51] Int. Cl.[6] ..... H01Q 1/34; H01Q 3/22

[52] U.S. Cl. ..... 343/709; 343/725; 343/372; 343/872; 343/854

[58] Field of Search ..... 343/709, 710, 343/723, 574, 766, 372, 725

[56] References Cited

U.S. PATENT DOCUMENTS

| | | | |
|---|---|---|---|
| 3,754,268 | 8/1973 | Boyns | 343/709 |
| 4,030,100 | 6/1977 | Perrotti | 343/709 |
| 4,329,690 | 5/1982 | Parker | 343/709 |
| 4,580,140 | 4/1986 | Cheston | 343/372 |
| 5,128,688 | 7/1992 | West | 343/766 |

*Primary Examiner*—Don Wong
*Assistant Examiner*—James Clinger
*Attorney, Agent, or Firm*—Michael J. McGowan; Robert W. Gauthier; Prithvi C. Lall

[57] ABSTRACT

The invention provides a hydrodynamically and stealth shaped suite of antennas and sensors mounted above a hydrodynamically and stealth shaped mast. The mast is configured to extend from the sail of a submerged vessel to the surface so as to provide the vessel with satellite communications capabilities. The hydrodynamic shape of the mast minimizes the surface wake and the stealth shape of the antenna suite and mast minimizes the radar cross section of the system, lessening detection by hostile forces. To obtain a stealth shape, the radar suite utilizes a conformal phased array antenna. In addition, electro-optical sensors in the antenna suite provide visual, environmental and other sensing capabilities to the system. Further, structurally embedded ESM antennas provide ESM and radar capabilities. When in the retracted position, the antenna system conforms to the hydrodynamic and stealth shape of the submerged vessel and the conformal phased array of the antenna suite forms an integral part of the conformal phased array of the vessel.

11 Claims, 3 Drawing Sheets

EXTENDIBLE PLANAR PHASED ARRAY MAST

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

1. Field of the Invention

The present invention relates generally to phased array antenna systems, and more particularly to a conformal phased array antenna mounted on an extendible mast.

2. Description of the Prior Art

The modern submarine requires high data rate communications to keep apprised of the constantly changing environment in which it operates. While submerged, the submarine uses its sonar systems to monitor the undersea environment and uses Extremely Low Frequency (ELF) transmissions for communications. Due to the low frequency, ELF communications cannot be used for high data rate transmissions. In order to obtain surface information or to perform high data rate communications with a surface vessel or satellite, it is necessary for the submerged vessel to extend an antenna or other communication means above the water surface. U.S. Pat. No. 3,754,268 to Boyns provides a phased array antenna system mounted in the periscope of a submarine. When a Super High Frequency (SHF) communications link between the submarine and an earth-orbiting satellite must be established, the periscope is extended such that the antenna system is above the surface. The surface wake of current antenna systems, or the periscope wake of the Boyns antenna system, provides an easy visual target for hostile forces. Further, the protruding antenna structure or, in the case of the Boyns antenna system, the periscope itself, provides an easily attained radar target for hostile forces. For some means of communications and ship sensor systems, such as line of sight RF communications and electro-optic (EO) sensors, the submarine must surface, or at a minimum expose the sail to allow operation of the communications equipment and sensors within the sail of the submarine. Current submarine sails present a very large visual and radar target. To minimize this threat, future submarine sails will incorporate stealth technology, will be hydrodynamically shaped to minimize wake and will incorporate conformal phased array antenna technology, all well known in the art. For example, U.S. Pat. No. 5,512,906 to Speciale describes such a conformal phased array. There remains a need to provide a system for extending communications equipment and sensors above the surface while the sail and submarine remain submerged. The system must not degrade the stealth characteristics of the sail, must be an integral part of the conformal arrays proposed for the stealth sail and must itself minimize visual and radar targets when deployed.

SUMMARY OF THE INVENTION

Accordingly, it is an object of the present invention to provide a satellite communications system for an underwater vessel which minimizes wake.

Another object of the present invention is to provide an antenna system which conforms to the stealth characteristics of future submarine sails and thus reduce the radar signature of the antenna system.

Still another object of the present invention is to provide an antenna system which incorporates a conformal phased array antenna which can be integrated with the proposed conformal phased array antenna systems of future submarines.

A still further object of the present invention is to provide an antenna system which incorporates additional sensor and communications means.

Other objects and advantages of the present invention will become more obvious hereinafter in the specification and drawings.

In accordance with the present invention, an antenna system is provided having a conformal phased array antenna mounted above an extendible, hydrodynamically shaped mast. The mast is configured to extend from the sail of a submarine to the surface so as to provide the submarine with satellite communications capabilities when the submarine is below the surface. The conformal phased array is also hydrodynamically shaped as well as stealth shaped, thus reducing visual wake and radar targets when compared to present antenna systems and periscope deployed antennas. The antenna also comprises electro-optical sensors and structurally embedded Electronic Systems Measurement (ESM) antennas, thus providing additional capabilities to the submarine when submerged. When the mast is retracted within the sail, the conformal phased array becomes an integral part of the sail, with the conformal array shape matching the hydrodynamic and stealth characteristics of future submarine sails.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1A:
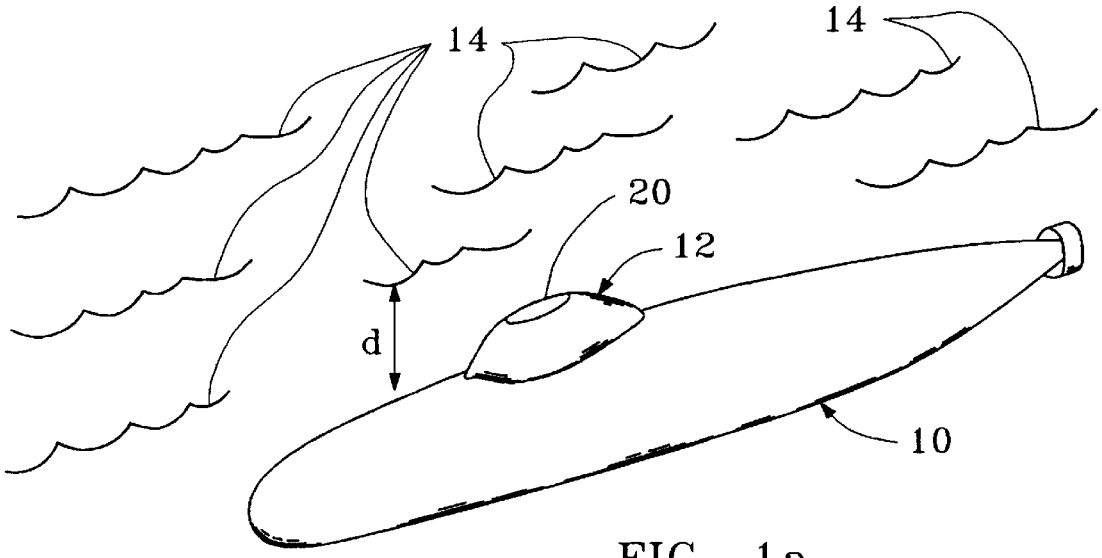
FIG. 1*a* is a schematic representation of the antenna system of the present invention shown prior to deployment from a submarine.
Figure 1B:
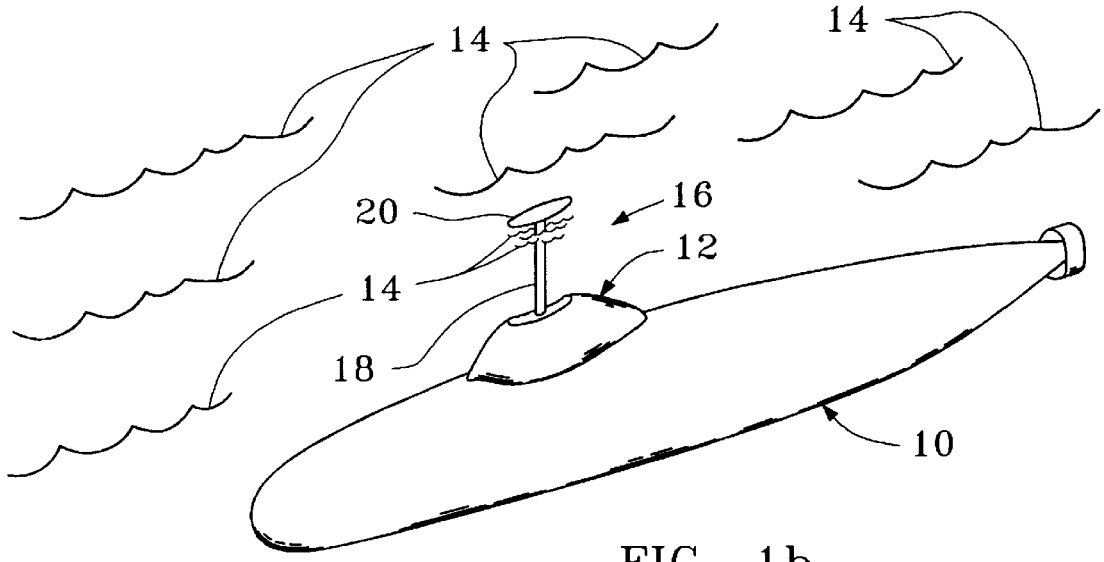
FIG. 1*b* is a schematic representation of the antenna system of the present invention shown deployed from a submarine.

Referring now to FIGS. 1*a* and 1*b*, there is shown a schematic representation of future submarine 10 having stealth sail 12. Submarine 10 is shown just below the water surface, illustrated as lines 14, at a depth "d" comparable with periscope depth of present day submarines. Stealth sail 12 is hydrodynamically shaped to minimize surface wake when traveling at depth "d". Submarine 10 travels at depth "d" when communications with earth orbiting satellites or with surface ships are required. To initiate communications while at depth "d", antenna system 16 is deployed from stealth sail 12 as shown in FIG. 1*b*. Antenna system 16 comprises an extendible mast 18 and an antenna suite 20 mounted on mast 18. Antenna suite 20 conforms to the shape of stealth sail 12, such that in the retracted position of FIG. 1*a*, antenna suite 20 forms an integral part of stealth sail 12. In the deployed position of FIG. 1*b*, conformal antenna suite 20 extends above surface 14 to facilitate communications. Mast 18 extends from stealth sail 12 of submarine 10. The extension of mast 18 from submarine 10 is accomplished in a manner similar to the raising of a periscope in a present day submarine. Mast 18 is also hydrodynamically shaped to minimize surface wake as well as being stealth shaped to minimize the radar cross section of those portions of mast 18 which may extend above surface 14.

Figure 2:
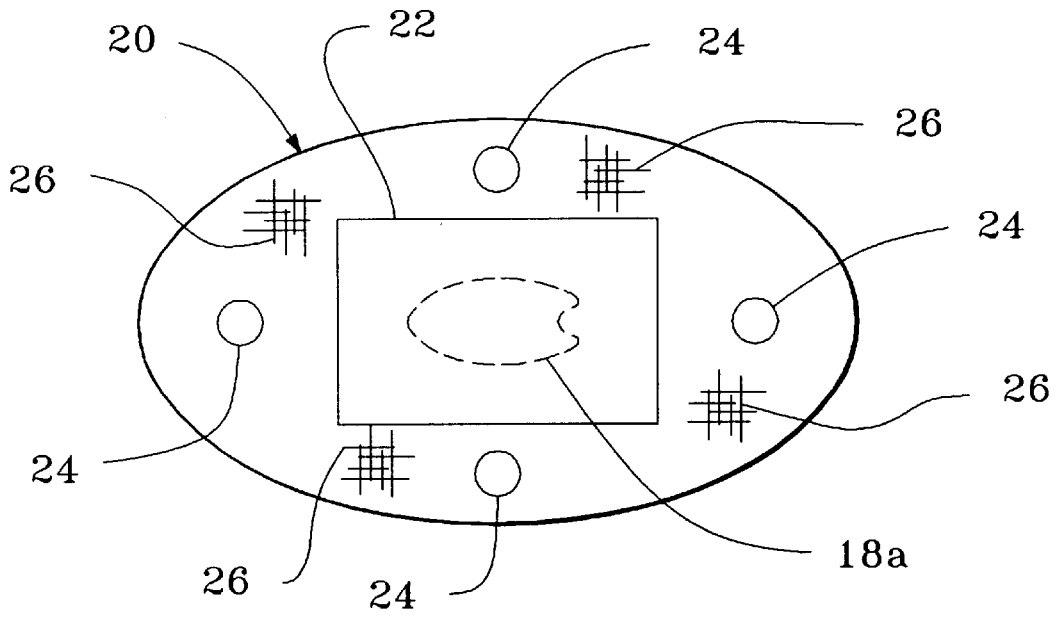
FIG. 2 is a top view of the antenna system of the present invention.

Referring now to FIG. 2, there is shown a top view of antenna suite 20. Conformal planar phased array 22 of antenna suite 20 provides for SHF satellite communications operating at between 7 and 9 GHz. Phased array 22 is electronically steerable to provide 90° coverage. Electro-optical sensors 24 are placed forward, aft and to each side of array 22. Sensors 24 can be a combination of environmental sensors, video, photonics, night vision, or other sensors dependent on the mission of submarine 10. In addition, structurally embedded ESM antennas, shown schematically as lines 26, provide ESM and radar capabilities. The location of mast 18 below antenna suite 20 is shown as dashed line 18*a* to illustrate the hydrodynamic shape of mast 18.

Figure 3:
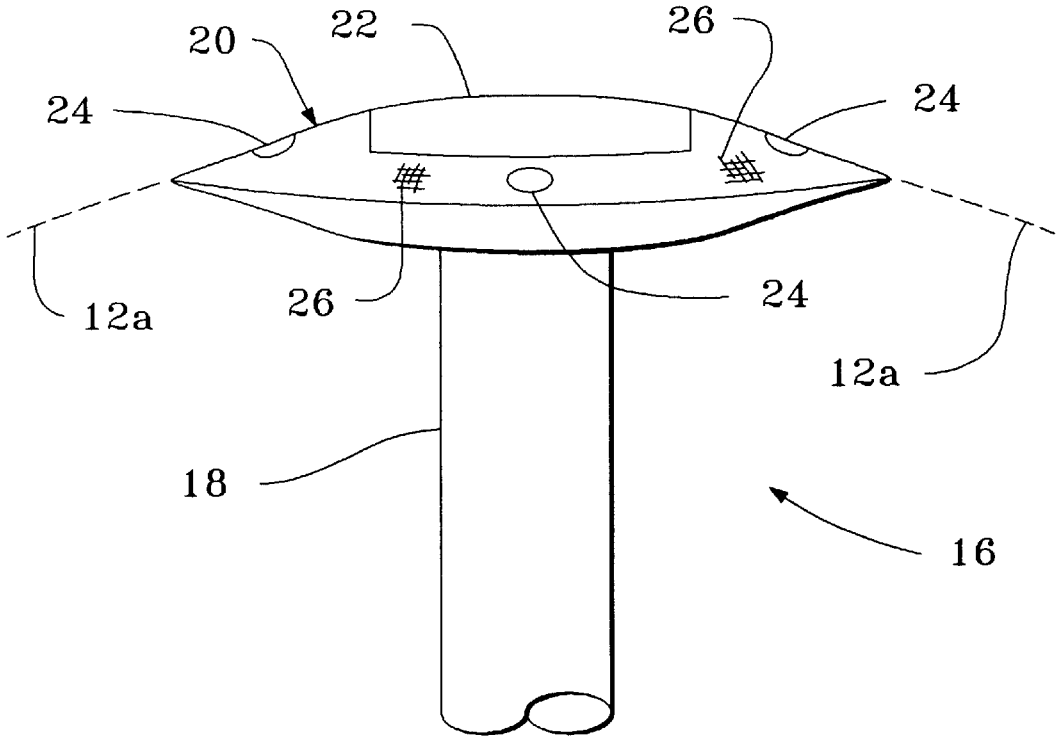
FIG. 3 is a side view of the antenna system of the present invention.

Referring now to FIG. 3, there is shown a side view of antenna system 16, with array 22, sensors 24 and ESM antennas 26 of antenna suite 20 mounted on mast 18. A portion of stealth sail 12 is shown as dashed line 12*a*, illustrating the conformal relationship of retracted antenna system 16 with sail 12. It can be seen that antenna suite 20 conforms to the hydrodynamic shape of stealth sail 12. In addition, antenna suite 22 is stealth shaped to minimize its radar cross section when deployed above the surface and to conform with the shape of stealth sail 12 when sail 12 is raised above the surface for additional sensing or communications operations.

The invention thus described provides a hydrodynamically and stealth shaped suite of antennas and sensors mounted above a hydrodynamically and stealth shaped mast. For high data rate communications from a submerged vessel to a satellite or surface vessel, the submerged vessel approaches to within a certain depth of the surface and extends the mast such that the suite of antennas is above the surface. The hydrodynamic shape of the mast minimizes the surface wake. The stealth shape of the antenna suite and mast minimizes the radar cross section of the system. To obtain a stealth shape, the radar suite utilizes a conformal phased array antenna. In addition, electro-optical sensors in the antenna suite provide visual, environmental and other sensing capabilities to the system. Further, structurally embedded ESM antennas provide ESM and radar capabilities. When in the retracted position, the antenna system conforms to the hydrodynamic and stealth shape of the submerged vessel and the conformal phased array of the antenna suite forms an integral part of the conformal phased array of the vessel.

Figure 4:
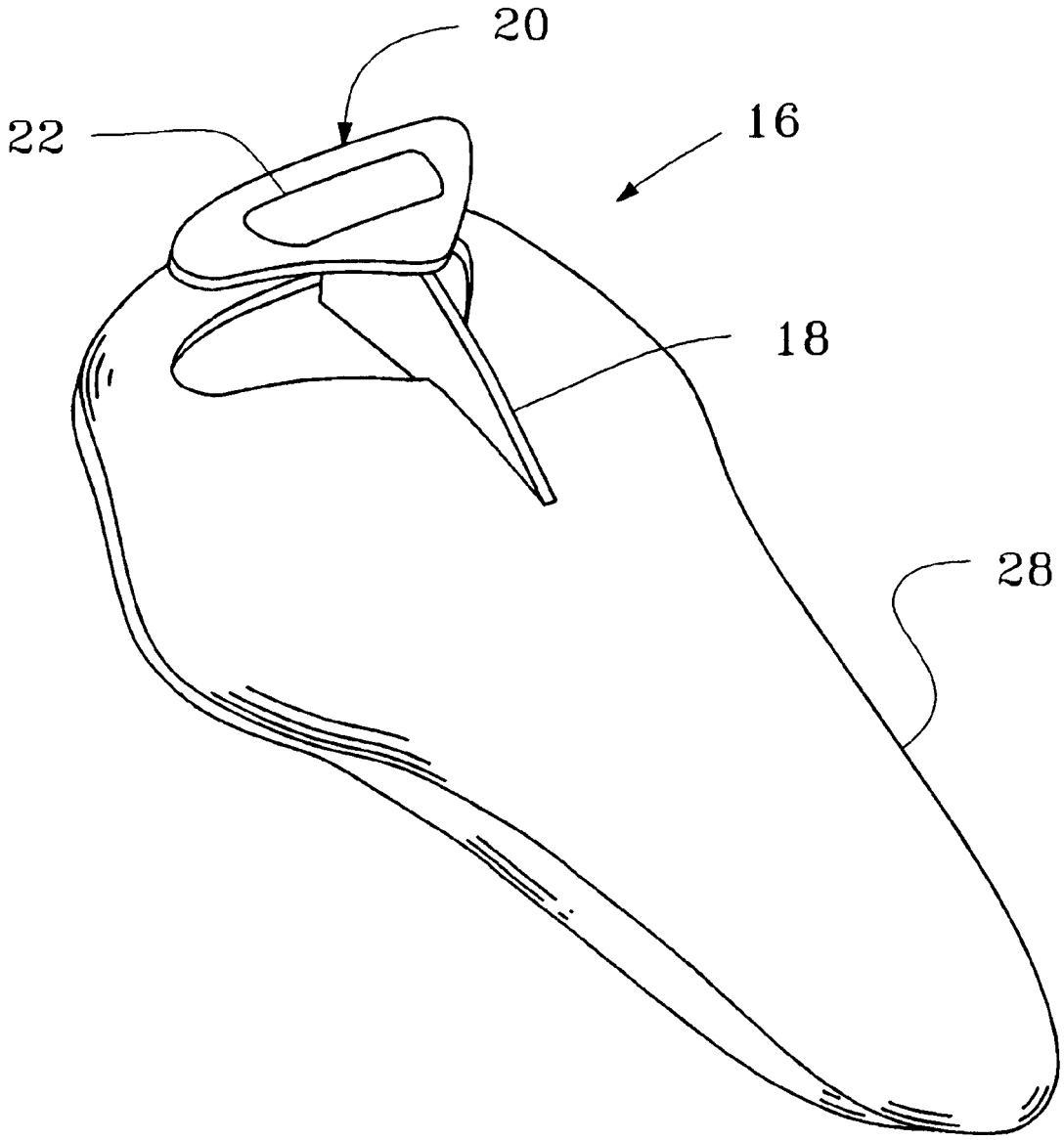
FIG. 4 is a schematic representation of an alternate embodiment of the antenna system of the present invention deployed from an autonomous undersea platform.

Although the present invention has been described relative to a specific embodiment thereof, it is not so limited. For example, the configuration of antenna suite 20 and the configuration of sensors 24 will depend on the mission of the vessel from which the antenna system is deployed. FIG. 4 shows a second embodiment of antenna system 16 of the present invention deployed on underwater platform 28. Platform 28 is an autonomous unmanned submersible providing an expanded theater of operations for a submarine or surface ship. In this embodiment, mast 18 is in the shape of a vertical stabilizer and antenna suite 20 is in the shape of a horizontal stabilizer. As with the embodiment of FIGS. 1–3, mast 18 can be retracted into platform 28 such that antenna suite 20 conforms to the hydrodynamic and stealth shape of platform 28 as well as having conformal phased array 22 forming an integral part of the conformal phased array of platform 28.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An antenna system for use in providing high data rate communications from a vessel submerged beneath a water surface, the system comprising:

a mast extensibly attached to the submerged vessel;

an antenna suite mounted on the mast such that the antenna suite is above the water surface when the mast is extended from the vessel, the antenna suite configured to provide a low radar cross section; and a phased array antenna within the antenna suite providing high data rate communications capabilities, the phased array antenna conforming to the configuration of the antenna suite, the phased array antenna forming an integral part of a conformal phased array antenna of the vessel when the mast is retracted.

2. The antenna system of claim 1 wherein the antenna suite further comprises electro-optical sensors, the sensors providing at least one of visual data and environmental data.

3. The antenna system of claim 1 wherein the antenna suite further comprises structurally embedded ESM antennas.

4. The antenna system of claim 1 wherein the mast is stealth shaped to provide a low mast radar cross section.

5. The antenna system of claim 1 wherein the antenna suite conforms to a hydrodynamic shape of the vessel when the mast is retracted.

6. The antenna system of claim 1 wherein the vessel is a submarine.

7. The antenna system of claim 1 wherein:

the vessel is an autonomous unmanned platform;

the mast forms a vertical stabilizer for the platform when the mast is extended; and the antenna suite forms a horizontal stabilizer for the platform when the mast is extended.

8. The antenna system of claim 7 wherein the antenna suite conforms to a hydrodynamic shape of the platform when the mast is retracted.

9. The antenna system of claim 7 wherein the phased array antenna forms an integral part of a conformal phased array antenna of the platform when the mast is retracted.

10. An antenna system for use in providing high data rate communications from a submarine submerged beneath a water surface, the system comprising:

a mast extensibly attached to the submarine, the mast being configured to provide a low mast radar cross section for the antenna system;

an antenna suite mounted on the mast such that the antenna suite is above the water surface when the mast is extended from the vessel, the antenna suite configured to provide a low radar cross section, the antenna suite conforming to a hydrodynamic shape of the submarine when the mast is retracted;

a phased array antenna within the antenna suite providing high data rate communications capabilities, the phased array antenna conforming to the configuration of the antenna suite and forming an integral part of a conformal phased array antenna of the submarine when the mast is retracted;

electro-optical sensors within the antenna suite, the sensors providing at least one of visual data and environmental data; and structurally embedded ESM antennas within the antenna suite.

11. An antenna system for use in providing high data rate communications from an autonomous, unmanned platform submerged beneath a water surface, the system comprising:

a mast extensibly attached to the platform and forming a vertical stabilizer of the platform when the mast is extended from the platform;

an antenna suite mounted on the mast and forming a horizontal stabilizer of the platform when the mast is extended, the antenna suite being above the water surface when the mast is extended from the platform for high data rate communications, the antenna suite conforming to a hydrodynamic shape of the platform when the mast is retracted;

a phased array antenna within the antenna suite providing high data rate communications capabilities, the phased array antenna conforming to the hydrodynamic shape of the antenna suite and forming an integral part of a conformal phased array antenna of the platform when the mast is retracted;

electro-optical sensors within the antenna suite, the sensors providing at least one of visual data and environmental data; and structurally embedded ESM antennas within the antenna suite.

* * * * *